US007410241B2

(12) United States Patent
Yabe

(10) Patent No.: US 7,410,241 B2
(45) Date of Patent: Aug. 12, 2008

(54) INK JET HEAD, INK JET PRINTER AND METHOD FOR MANUFACTURING INK JET HEAD

(75) Inventor: Kenji Yabe, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 424 days.

(21) Appl. No.: 11/219,760

(22) Filed: Sep. 7, 2005

(65) Prior Publication Data

US 2006/0055731 A1 Mar. 16, 2006

(30) Foreign Application Priority Data

Sep. 13, 2004 (JP) ..... 2004-265271

(51) Int. Cl.
*B41J 2/14* (2006.01)
*B41J 2/135* (2006.01)

(52) U.S. Cl. ..... 347/47; 347/45

(58) Field of Classification Search ..... 347/40–42, 347/47, 45

See application file for complete search history.

(56) References Cited

U.S. PATENT DOCUMENTS 5,572,244 A * 11/1996 Drake et al. ..... 347/42
6,145,965 A 11/2000 Inada et al.
6,152,559 A * 11/2000 Kojima ..... 347/89
6,286,933 B1 9/2001 Murakami et al.
6,575,560 B2 6/2003 Kaneko et al.
6,799,831 B2 10/2004 Inamoto et al.
6,964,467 B2 11/2005 Kaneko et al.
7,240,855 B2 * 7/2007 Takagi et al. ..... 239/102.2
2006/0071969 A1 4/2006 Kaneko et al.

FOREIGN PATENT DOCUMENTS

JP 9-1809 1/1997
JP 11-5307 1/1999
JP 2001-171119 6/2001

* cited by examiner

*Primary Examiner*—An H Do
(74) *Attorney, Agent, or Firm*—Fitzpatrick, Cella, Harper & Scinto

(57) ABSTRACT

An ink jet head, which can prevent non-discharge due to face wetting, has an ink nozzle for discharging ink through a discharge port communicating with the ink nozzle and formed in a water-repelling surface. A hydrophilic groove is formed in a nozzle plate in which the ink nozzle is formed to be directed toward the water-repelling surface in a concave fashion. The hydrophilic groove is provided between plural nozzle arrays and a capillary force of the hydrophilic groove is greater at end portions thereof than at a central portion thereof.

10 Claims, 12 Drawing Sheets

INK JET HEAD, INK JET PRINTER AND METHOD FOR MANUFACTURING INK JET HEAD

BACKGROUND OF THE INVENTION

1. Field of the Invention

The present invention relates to an ink jet head, an ink jet printer and a method for manufacturing an ink jet head. More particularly, the present invention relates to an ink jet head, an ink jet printer and a method for manufacturing an ink jet head, in which multiple ink nozzles are arranged in a sub-scan direction in each of a plurality of nozzle arrays arranged in a main scan direction.

2. Related Background Art

As one of ink jet printers, an ink jet printer in which an ink jet head mounted on a carriage is reciprocally moved in a main scan direction and a recording medium is moved in a sub-scan direction, and recording is performed on the recording medium by using an ink droplet discharged from the ink jet head has conventionally been known.

In the ink jet head used in the above-mentioned printer, ink nozzles are arranged in the sub-scan direction to form a nozzle array, and, in general, a plurality of nozzle arrays are arranged in the main scan direction to permit color recording. Among these heads, as disclosed in Japanese Patent Application Laid-open No. 2001-171119, there is an ink jet head in which nozzles for discharging color ink are disposed symmetrically in a left-and-right direction and offset by a half pitch, which head has excellent performance for performing reciprocal printing.

Among these ink jet heads, as disclosed in Japanese Patent Application Laid-open No. H11-5307, an ink jet head having vaporization suppressing grooves in the vicinity of discharge ports in order to suppress vaporization of ink from the discharge ports and to prevent unstable discharging is known. Further, in a method for manufacturing an ink jet head in which, after resin is coated on a mold for forming flow paths, the mold is removed to form the flow paths, a groove is provided in a nozzle surface (referred to as "face surface" hereinafter) to make a thickness of the resin uniform, as disclosed in Japanese Patent Application Laid-open No. H09-001809.

By the way, in a case where the recording is performed by using the ink jet head, following a main ink droplet, minute ink droplet or droplets may be generated delayed from the main ink droplet. Further, when the main ink droplet strikes against a recording medium, due to an ink rebound phenomenon, minute ink droplet or droplets may be generated. These minute ink droplets are called "ink mist" and are adhered to the face surface by an air flow caused by the movement of the carriage and the liquid droplet itself. Further, the ink mist adhered to the face surface may be gathered to create ink mass (referred to as "face wet region" hereinafter). If the face wet region appears in the vicinity of the discharge port, a discharging direction of the discharged ink droplet may be unstable to cause so-called dot mis-alignment that an ink dot cannot strike against a desired position. To avoid this, a technique in which the face surface is formed as a water-repelling surface to reduce the amount of the ink mist remaining in the vicinity of the discharge port, thereby minimizing the influence affecting upon the discharging performance, has been proposed.

However, the Inventor discovered that, if the ink mist is adhered to the water-repelling surface collectively, the following phenomenon may be generated.

That is to say, in a case where the face wet region is generated for example by extremely increasing driving frequency for performing the ink discharging, when a diameter of the face wet region reaches about 100 μm or more, the ink mist can easily be moved on the face surface. Thus, the face wet region will be combined with adjacent face wet region(s) to create a greater face wet region due to an inertia force generated during the reciprocal scanning operations of the head. If so grown greater face wet region exists on the face surface, as the case may be, the face wet region covers or closes the discharge ports in a condition that bubbles exist in the nozzles, non-discharge occurs during the recording. It is feared that such a phenomenon is generated also in the arrangements disclosed in the above-mentioned Japanese Patent Application Laid-open Nos. H11-005307 and H09-001809.

Although this problem can be solved by performing a recovery process in which the face surface is cleaned by a blade and the like and the ink is sucked, if the recovery process is carried out frequently during the recording operation, the recording speed will be sacrificed. Since it is expected that the number of nozzles will increase in future ink heads as compared to conventional ink heads due to higher image quality and higher printing speed, the above-mentioned problem will be more remarkable. Thus, there is a need for realizing new solving methods different from the conventional ones.

SUMMARY OF THE INVENTION

The present invention can provide an ink jet head, an ink jet printer and a method for manufacturing an ink jet head which can solve the above-mentioned problem and in which, even when ink droplets are discharged continuously with high frequency, a discharging condition can be kept stable without executing recovery processes frequently.

The present invention can provide an ink jet head in which an ink droplet is discharged from any of plural ink nozzles toward a recording medium when the ink jet head is relatively moved to the recording medium and wherein a plurality of nozzle arrays in which the plural ink nozzles are provided are arranged along the relatively moving direction and concave-shaped hydrophilic grooves are continuously disposed between the respective plural nozzle arrays along a sub-scan direction and a capillary force of the groove is greater at end portions thereof than at a central portion thereof.

Further, an ink jet recording apparatus according to the present invention utilizes the above-mentioned ink jet head and comprises a main scan mechanism for moving the ink jet head in a main scan direction, a sub-scan mechanism for moving the recording medium in the sub-scan direction at a position opposed to the ink jet head, an integration control circuit for integrating and controlling operations of the ink jet head, main scan mechanism and sub-scan mechanism, and capping means for recovering a function of a discharge port, and the ink jet head is held by the main scan mechanism so that the plural nozzle arrays are aligned in the main scan direction.

Further, according to the present invention, a method for manufacturing an ink jet head which has a nozzle for discharging an ink droplet and in which ink is discharged from a discharge port communicated with the nozzle and formed in a water-repelling surface toward a recording medium comprises the step of forming a concave-shaped hydrophilic groove in the water-repelling surface.

According to the present invention, since the concave-shaped hydrophilic groove is formed in the water-repelling surface in which the discharge port is formed, non-discharge due to the presence of the face wet region can be prevented. Accordingly, even in a case where the ink is discharged continuously with high frequency, a discharging condition can be kept stable without carrying out cleaning of the face surface and ink suction frequently.

BRIEF DESCRIPTION OF THE DRAWINGS

FIG. 3A is a sectional view taken along the line 3A-3A in FIG. 1 and FIG. 3B is a sectional view taken along the line 3B-3B in FIG. 1;

FIG. 4A is a plan view of a silicon substrate and FIG. 4B is a longitudinal sectional front view of the ink jet head;

DESCRIPTION OF THE PREFERRED EMBODIMENTS

First Embodiment

Figure 1:
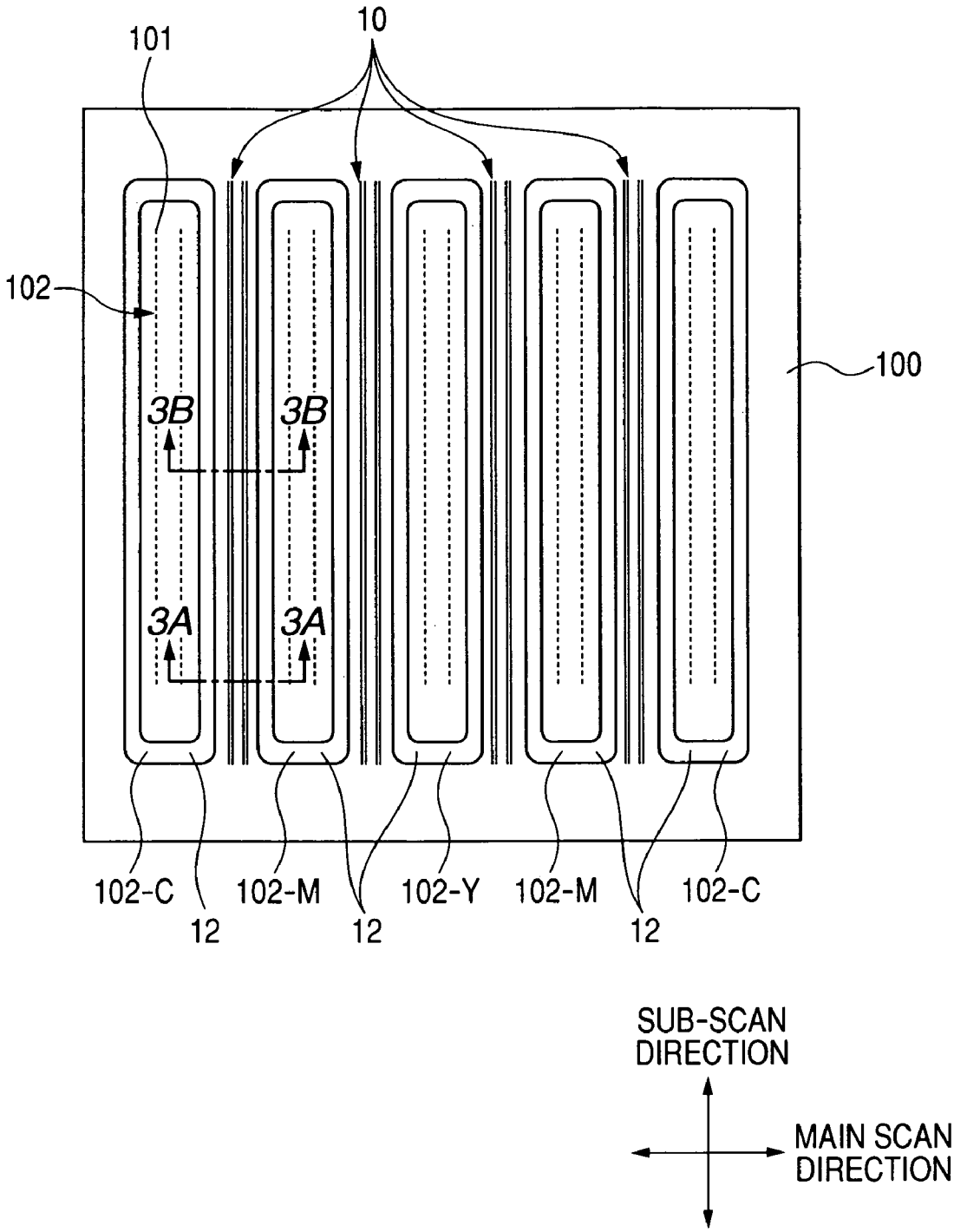
FIG. 1 is a plan view showing patterns of ink nozzles and hydrophilic grooves in an ink jet head according to a first embodiment of the present invention.
Figure 2:
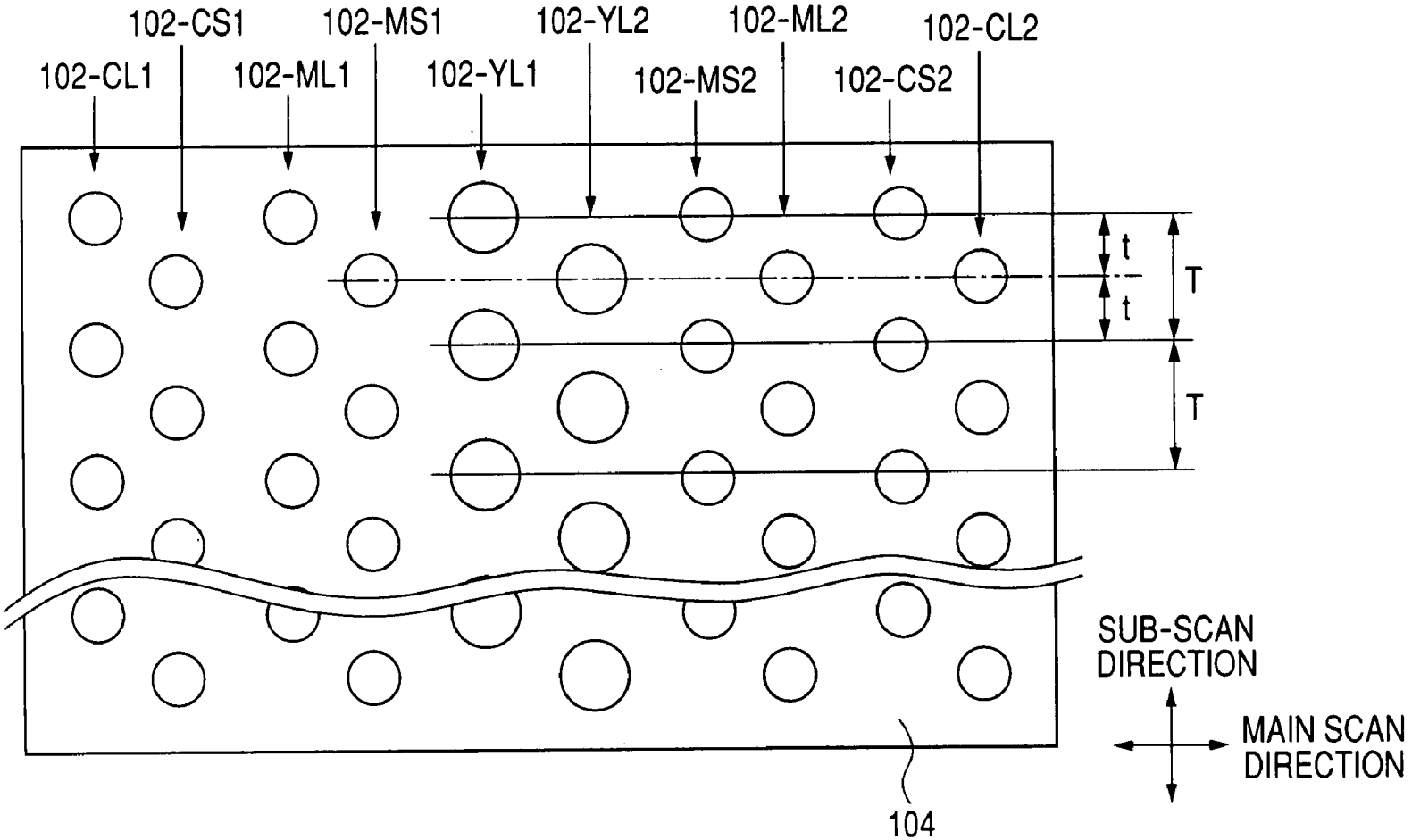
FIG. 2 is a plan view showing an arrangement pattern of the ink nozzles included in the ink jet head according to the first embodiment of the present invention.
Figure 3A:
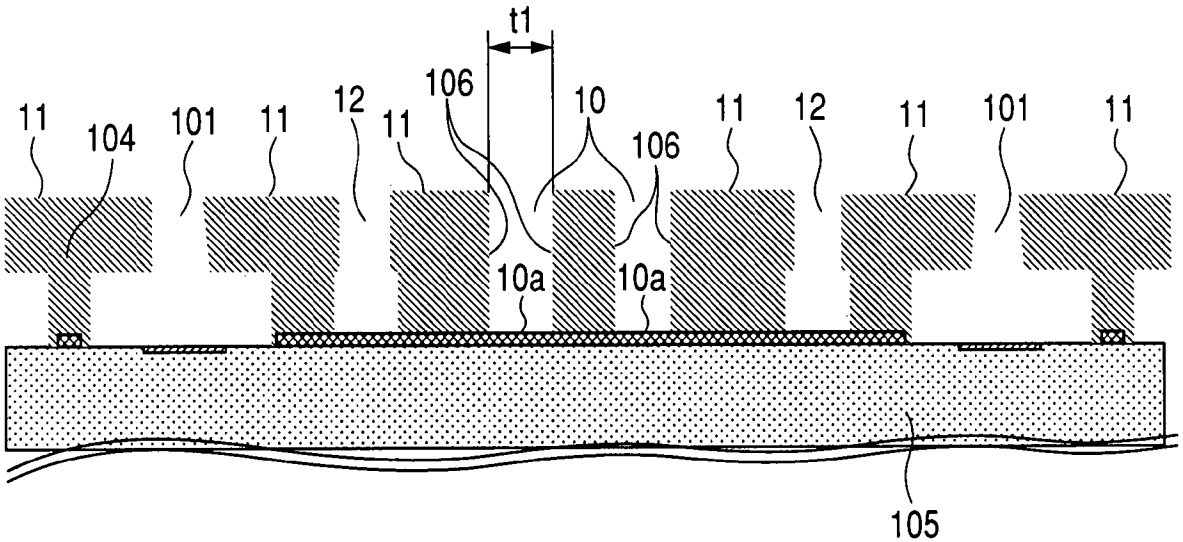
FIGS. 3A and 3B are sectional views showing patterns of the ink nozzles and the hydrophilic grooves of the ink jet head, where
Figure 3B:
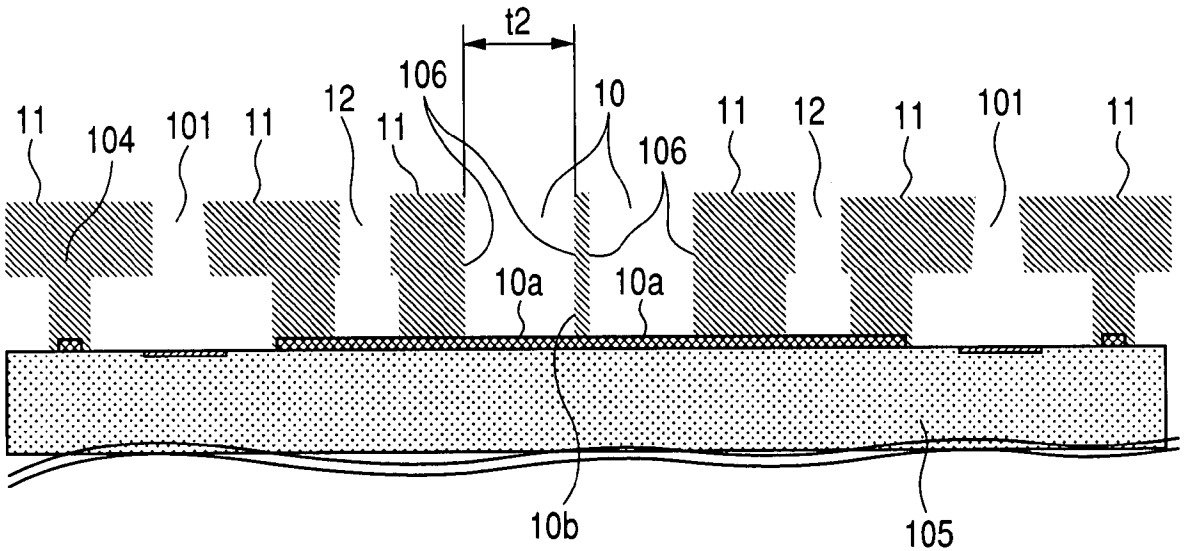

FIG. 1 is a plan view showing patterns of ink nozzles and hydrophilic grooves of an ink jet head according to a first embodiment of the present invention. FIG. 2 is a plan view showing an arrangement pattern of the ink nozzles included in the ink jet head according to the first embodiment of the present invention. FIGS. 3A and 3B are sectional views showing the patterns of the ink nozzles and the hydrophilic grooves of the ink jet head according to the first embodiment of the present invention, where FIG. 3A is a sectional view taken along the line 3A-3A in FIG. 1 and FIG. 3B is a sectional view taken along the line 3B-3B in FIG. 1.

As shown in FIG. 1, an ink jet head 100 according to the illustrated embodiment is of reciprocal type corresponding to full color printing. In the ink jet head, ten nozzle arrays 102 each including multiple ink nozzles 101 arranged along a sub-scan direction are arranged in a main scan direction. More specifically, as shown in FIG. 2, the ten nozzle arrays 102 are constituted by nozzle arrays 102-Y, 102-M and 102-C for discharging Y (yellow) color, M (magenta) color and C (cyan) color (three primary colors) ink droplets D (for example, refer to FIG. 9A), respectively. These Y, M and C nozzles arrays 102-Y, 102-M and 102-C are disposed symmetrically around the Y color nozzle arrays in the main scan direction. That is to say, from one end to the other end in the main scan direction, nozzles arrays 102-CL1, 102-CS1, 102-ML1, 102-MS1, 102-YL1, 102-YL2, 102-MS2, 102-ML2, 102-CS2 and 102-CL2 are arranged in order. Incidentally, each of the ink nozzles 101 in the M and C nozzle arrays 102-M and 102-C has a circular configuration having a diameter of about "10 "μm)".

Further, in the ink jet head 100 according to the illustrated embodiment, since each nozzle array 102 includes the ink nozzles 101 arranged with a density of 600 dpi (dots per inch), an arrangement distance between the ink nozzles 101 in each nozzle array 102 is about 42 μm.

Further, in the ink jet head 100 according to the illustrated embodiment, the arrangement pitch of the nozzle arrays 102-L and the arrangement pitch of the nozzle arrays 102-S are about 1.4 mm and the arrangement pitch between the same color nozzle arrays 102 is about 0.25 mm. In this case, an ink supply port or path 111 is disposed between the adjacent same color nozzle arrays 102-L and 102-S.

Namely, the nozzles 101-L and 101-S associated with the same ink supply port 111 are arranged in the main scan direction in a manner like a hound's-tooth check with a period of about 21 μm.

Further, as shown in FIGS. 1, 3A and 3B, around the respective Y, M and C nozzles arrays 102-Y, 102-M and 102-C, recesses 12 as disclosed in the Japanese Patent Application Laid-open No. H09-001809 are provided. In the illustrated embodiment, the recess has a constant width (about 100 μm) and is situated at a position spaced apart from the nozzles by about 150 μm.

Regarding hydrophilic grooves 10 which are one of the characteristics of the present invention, as shown in FIG. 1, hydrophilic grooves are disposed at four positions between the different color nozzle rows (between 102-C and 102-M and between 102-M and 102-Y); that is, two substantially parallel hydrophilic grooves are disposed at a substantially middle position between the different color nozzle rows. The "middle" means that a center line between the two hydrophilic grooves 10 coincides with a center line between the different color nozzle rows. Further, in case of a single hydrophilic groove 10, the middle position means a center line of the hydrophilic groove 10. Further, in a case where three or more hydrophilic grooves 10 are provided, similarly, if the number of grooves is even, a center line between two central grooves substantially coincides with the center line between the nozzle rows, and, if the number of grooves is odd, the central groove 10 means the center line between the nozzle rows.

A cross-sectional area of a cross-section of the hydrophilic groove 10 perpendicular to the sub-scan direction is not uniform in the main scan direction. That is to say, as shown in FIGS. 3A and 3B, a width of the hydrophilic groove 10 along the nozzle row direction is greatest at a central portion of the nozzle row and is gradually decreased toward end portions of the nozzle row.

If a distance between the hydrophilic grooves 10 in the sub-scan direction i.e. a width of a water-repelling surface in which the hydrophilic groove 10 is not formed exceeds 500 μm, many face wet regions may be created. Accordingly, in the illustrated embodiment, a width of the hydrophilic groove 10 is set or determined so that a width of the water-repelling surface 11 in the vicinity of the central portion of the nozzle row along the main scan direction does not exceed 200 μm. As a result, as an arrangement of the hydrophilic groove 10, two parallel grooves each having a central width (t2 in FIG. 3B) of about 120 μm and an end width (t1 in FIG. 3A) of about 80 μm are used. That is to say, between the tangential line at the hydrophilic groove 10 side of the nozzle array and the edge line at the nozzle array side of the hydrophilic groove 10, the width of the water-repelling surface is 500 μm or less and the width of the hydrophilic groove 10 is 500 μm or less. Further, the width of the water-repelling surface between the hydrophilic grooves 10 is 500 μm or less.

Further, a cross-sectional area of the hydrophilic groove 10 is greatest at the central portion and is gradually decreased toward the ends thereof and a longitudinal length of the hydrophilic groove is equal to or slightly longer than that of the nozzle row. Incidentally, a sectional portion of the nozzle plate 104 is not subjected to water-repelling treatment. Further, a bottom surface 10*a* and side walls 10*b* of the hydrophilic groove 10 are also not subjected to the water-repelling treatment. That is to say, the bottom surface 10*a* and side walls 10*b* of the hydrophilic groove 10 are more hydrophilic than the surface of the nozzle plate. Incidentally, either the bottom surface 10*a* or the side walls 10*b* may be hydrophilic.

When the ink mist is collected into the hydrophilic groove 10, the ink mist is accumulated along the sectional portion of the nozzle plate. Further, since the sectional area of the hydrophilic groove 10 is decreased toward the ends thereof, the ink mist adhered to the central portion of the hydrophilic groove 10 flows along the sectional portion of the nozzle plate and is accumulated at both longitudinal ends of the groove.

With the hydrophilic groove 10 having such a construction, the ink mist in the central portion of the hydrophilic groove 10 to which the face mist is apt to be adhered can be dispersed in the direction of the nozzle row. As a result, it is possible to prevent occurrence of a phenomenon in which the face mist is excessively accumulated at the central portion of the hydrophilic groove 10 locally to overflow the ink mist, thereby promoting the growth of many face wet regions.

In the manufacture of the nozzle plate, if the recesses 12 are not provided, since the water-repelling surface areas between the Y color, M color and C color nozzle arrays 102-Y, 102-M and 102-C become great, it is preferable that the widths of the hydrophilic grooves 10 be widened. Alternatively, the hydrophilic grooves 10 may additionally be provided at positions where the recesses 12 are to be provided.

Next, a method for manufacturing the ink jet head according to the illustrated embodiment will be explained with reference to FIGS. 4A and 4B and FIGS. 5A to 5I.

Figure 4A:
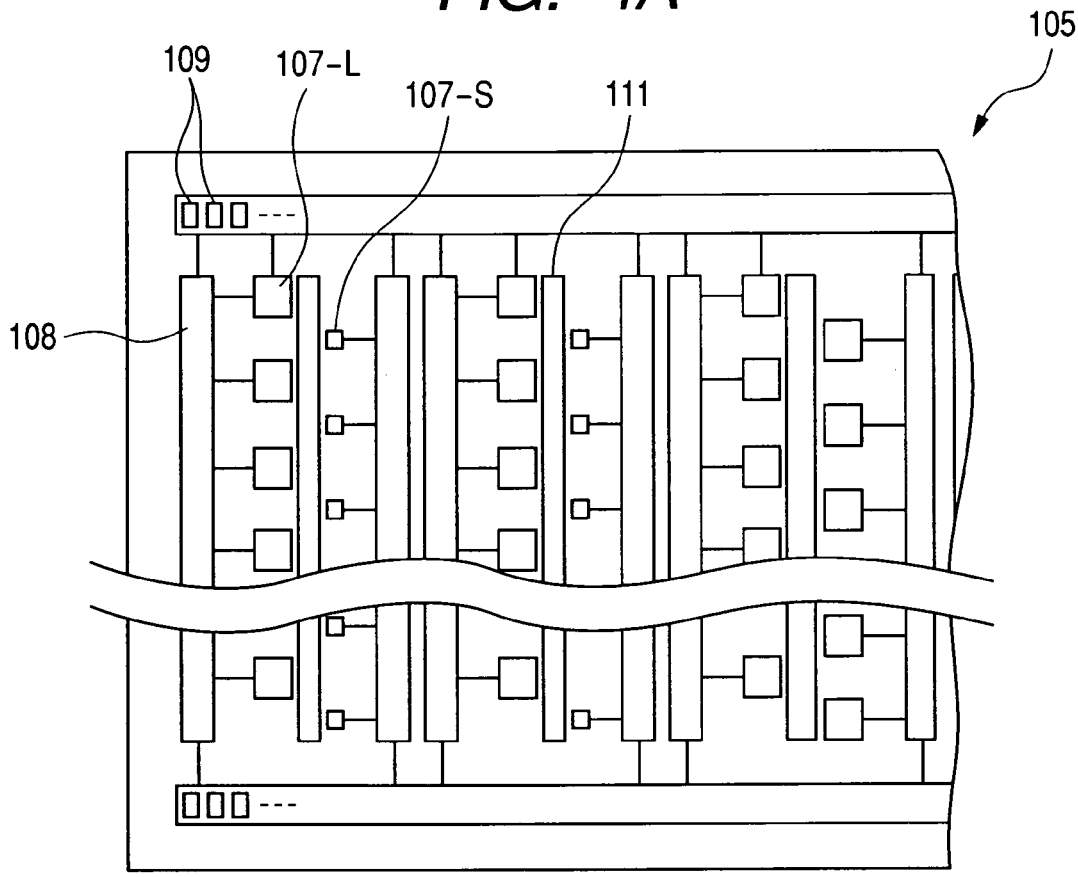
FIGS. 4A and 4B are views showing an internal structure of the ink jet head according to the first embodiment of the present invention, where
Figure 4B:
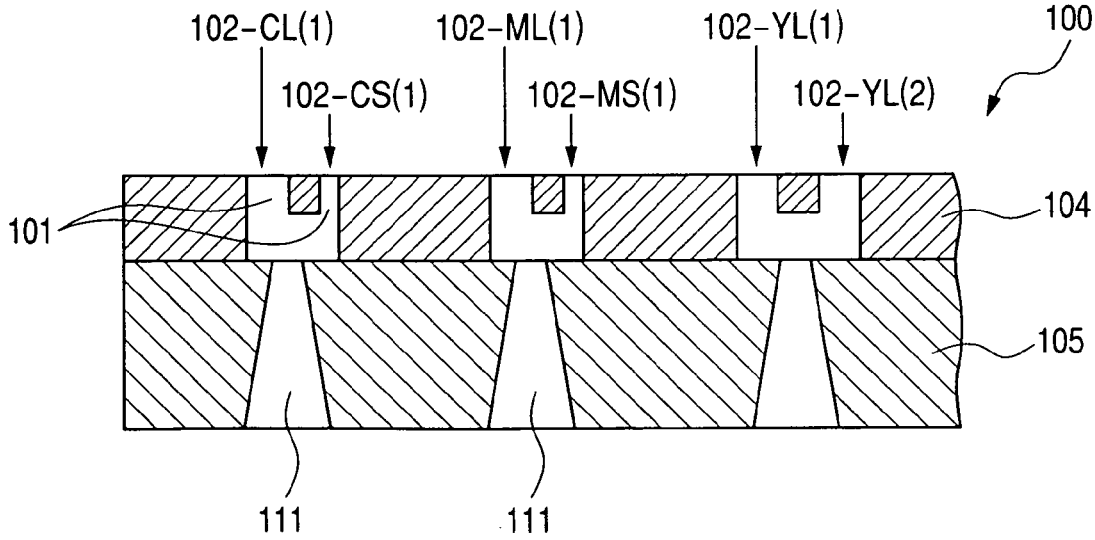

FIGS. 4A and 4B show an internal structure of the ink jet head. FIG. 4A is a plan view of a silicon substrate and FIG. 4B is a longitudinal sectional view of the ink jet head. As shown in FIG. 4B, the ink jet head 100 according to the illustrated embodiment includes the nozzle plate 104 and silicon substrate 105 which are laminated with each other. The ink nozzles 101 are formed in the nozzle plate 104 and the adjacent nozzle arrays 102 associated with the same color are communicated with each other in the interior of the nozzle plate 104.

The silicon substrate 105 is made of silicon for example, and, as shown in FIG. 4A, heat generating elements 107-L and 107-S as ink discharging means are formed on the surface of the silicon substrate at positions corresponding to the ink nozzles 101. Ink droplets D are discharged from the ink nozzles 101 by creating bubbles in the ink by means of the heat generating elements 107-L and 107-S. In the illustrated embodiment, a dimension of the heat generating element 107-L corresponding to the large diameter ink nozzle 101-L is 22×22 μm and a dimension of the heat generating element 107-S corresponding to the small diameter ink nozzle 101-S is 20×20 μm.

Drive circuits 108 are provided at positions adjacent to the heat generating elements 107-L and 107-S along the main scan direction and the heat generating elements 107-L and 107-S are connected to the adjacent drive circuits 108, respectively. Further, multiple connecting terminals 109 are formed on the surface of the silicon substrate 105 in the vicinity of both ends thereof in the sub-scan direction and the drive circuits 108 are connected to the connecting terminals 109.

Since the ink supply paths 111 are formed in the silicon substrate 105 in association with the adjacent same color nozzle arrays 102, as shown in FIG. 4A, each ink supply path 111 is commonly communicated with the adjacent same color nozzle arrays 102. Incidentally, since the ink supply path 111 is formed in the silicon substrate 105 made of <100> silicon by anisotropy etching, as shown in FIG. 4B, a sectional shape of the ink supply path is trapezoidal.

Figure 5A:
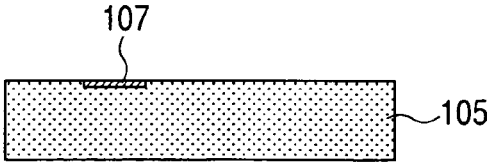
FIGS. 5A, 5B, 5C, 5D, 5E, 5F, 5G, 5H and 5I are schematic sectional views showing manufacturing steps for a nozzle plate of the ink jet head according to the first embodiment of the present invention.
Figure 5B:
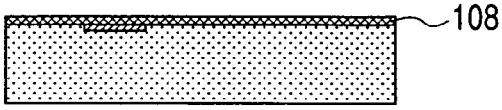
Figure 5C:
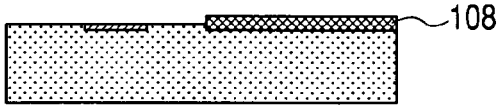

In such a method for manufacturing the ink jet head, first of all, as shown in FIG. 5A, electrothermal transducing elements (TaN) as the heat generating elements 107 are disposed on the silicon substrate 105, and, as protection layers, an SiN layer and a Ta layer (not shown) are formed. Then, as shown in FIG. 5B, a resin layer made of polyether amide as a close contact layer 108 is formed on the silicon substrate 105. Then, as shown in FIG. 5C, the close contact layer 108 is patterned by using a resist or the like.

Figure 5D:
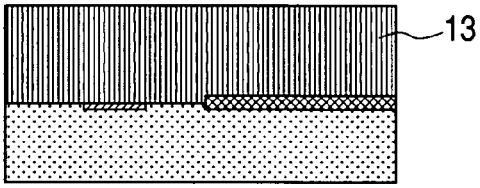
Figure 5E:
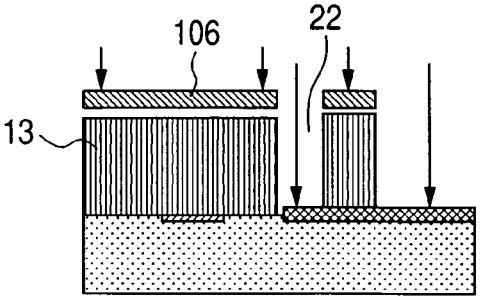
Figure 5F:
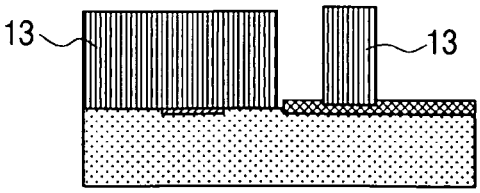

Then, as shown in FIG. 5D, after positive-resist ODUR 13 manufactured by Tokyo Ohka Kogyo CO. Ltd. was coated on the substrate 105, as shown in FIG. 5E, exposure is performed by using a mask member 106 and then development is performed to form a pattern of ink flow paths 22 (FIG. 5F). In this case, in order to enhance surface flatness of a flow path constituting member 14 which will be described later, the positive-resist ODUR 13 having a width of about 100 μm is left at a position spaced apart from the pattern of the ink flow paths by about 150 μm.

Figure 5G:
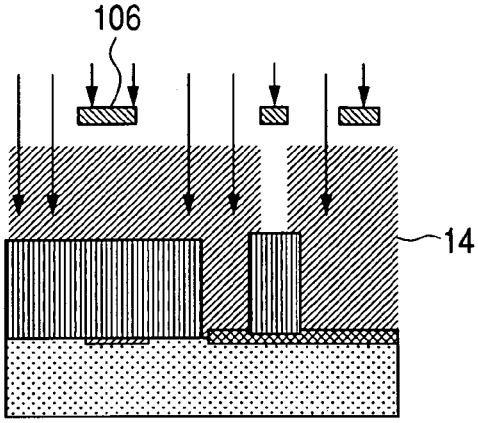
Figure 5H:
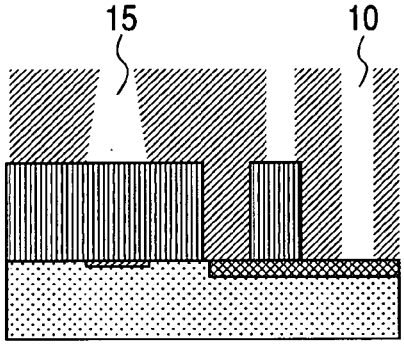

Then, as shown in FIG. 5G, the flow path constituting member 14 made of epoxy resin is formed on the substrate 105, and exposing and developing processes are performed by using the mask member 106 to form discharge ports 15 (FIG. 5H). In this case, similarly, any pattern is provided around the discharge port rows by using the mask member 106, thereby forming the hydrophilic grooves 10 of the nozzle plate which is one of the characteristics of the present invention.

Figure 5I:
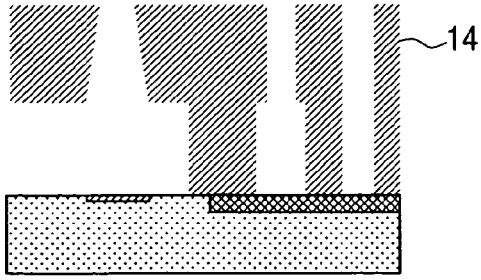

Then, the ink supply paths 10 are formed by performing Si anisotropy etching with respect to the substrate 105 (FIG. 5I).

Further, a water-repelling agent coated on a flexible member such as silicone rubber is transferred onto a face surface of the flow path constituting member 14 and a water-repelling process for the ink jet head is carried out through a drying process and a hardening process. In this way, the manufacturing process for the nozzle plate is completed.

Next, an ink jet printer on which the ink jet head according to the illustrated embodiment is mounted and an ink jet cartridge will be explained with reference to FIGS. 6 to 8.

Figure 6:
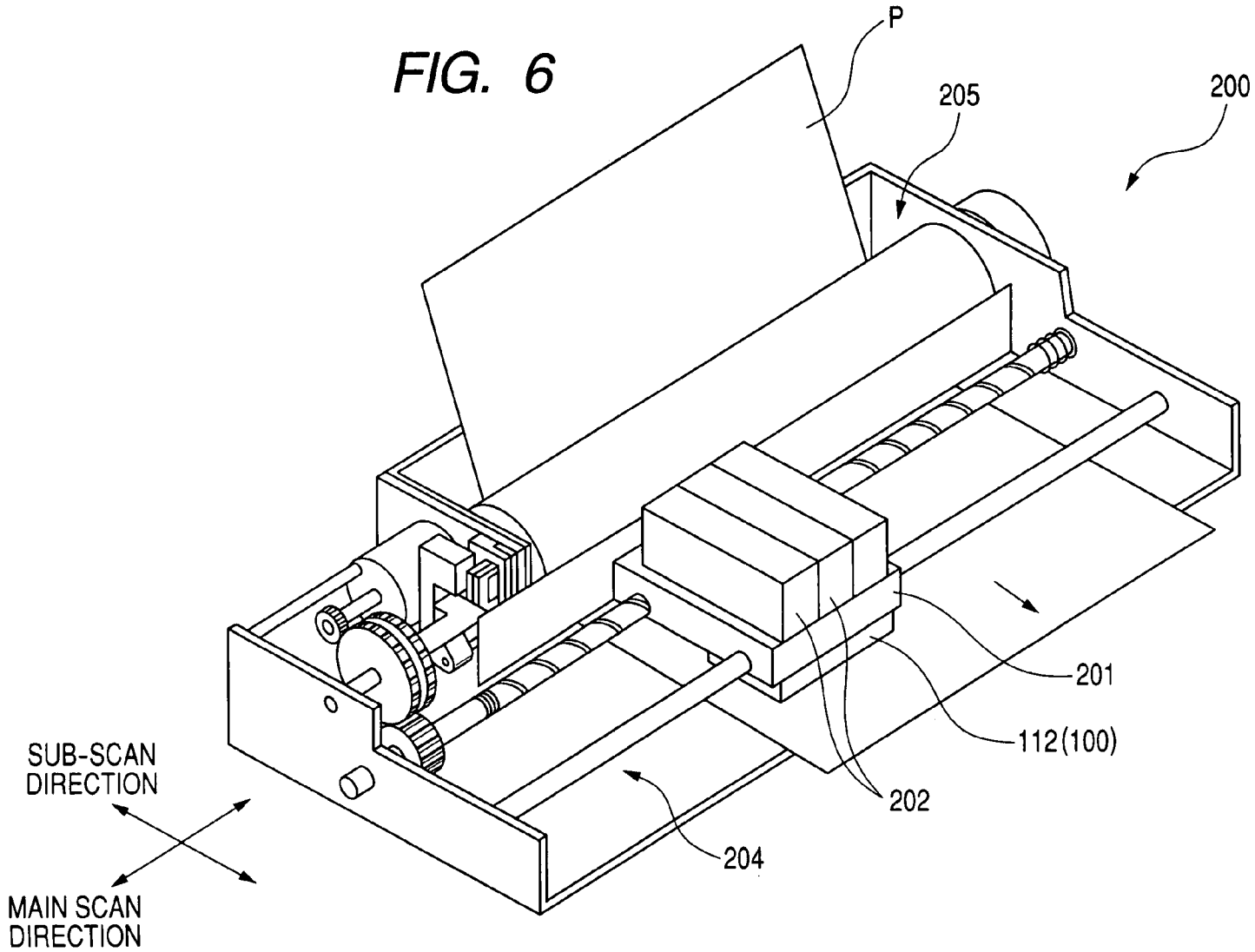
FIG. 6 is an exploded perspective view showing a condition that an ink cartridge according to the first embodiment of the present invention is mounted on a carriage.
Figure 7:
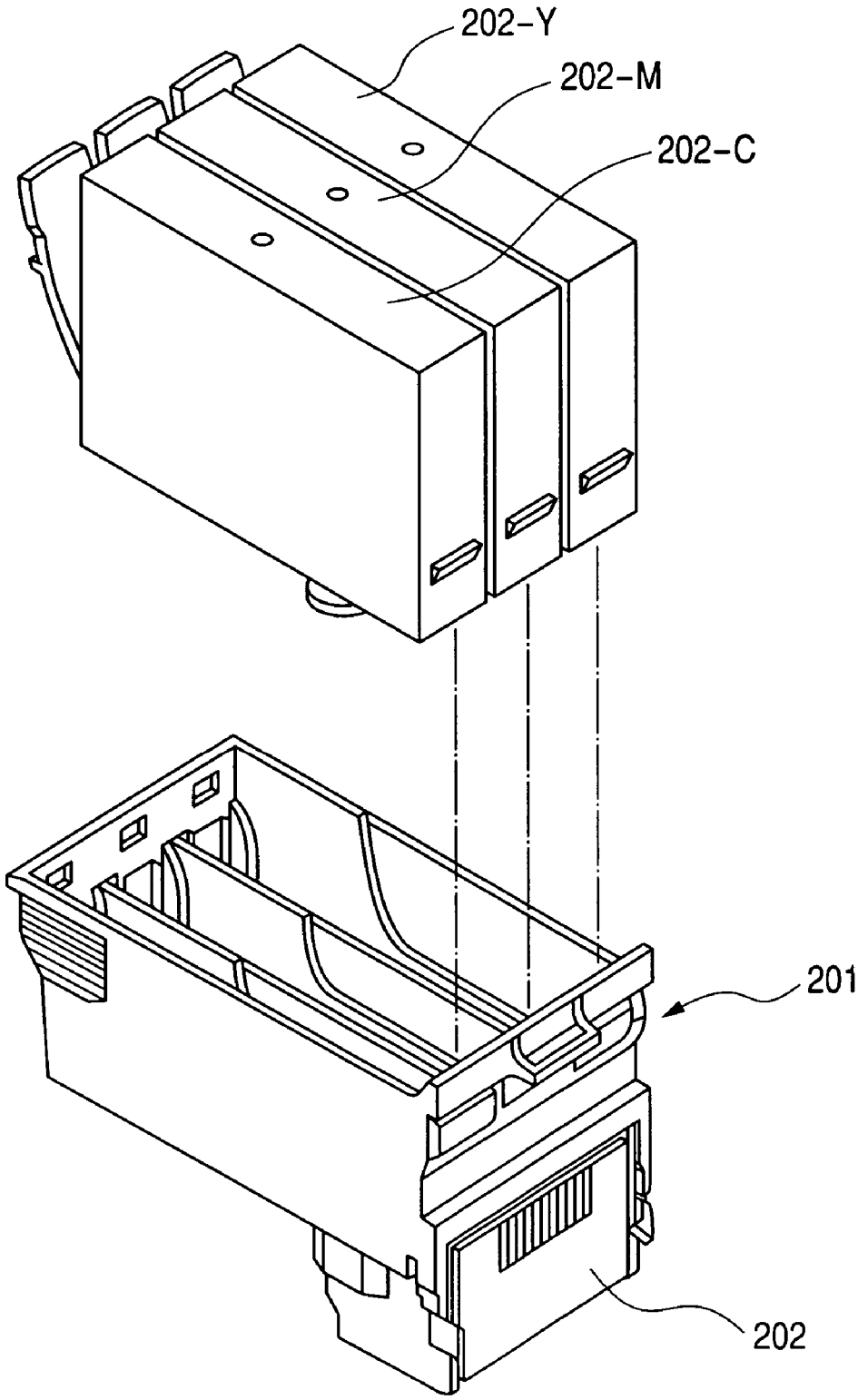
FIG. 7 is a perspective view showing an internal structure of an example of an ink jet printer of the present invention.

As shown in FIG. 6, the ink jet head 100 according to the illustrated embodiment is formed as a part of an ink jet printer 200 and is mounted on a carriage 201 of the ink jet printer according to this embodiment, as shown in FIGS. 6 and 7.

Figure 8:
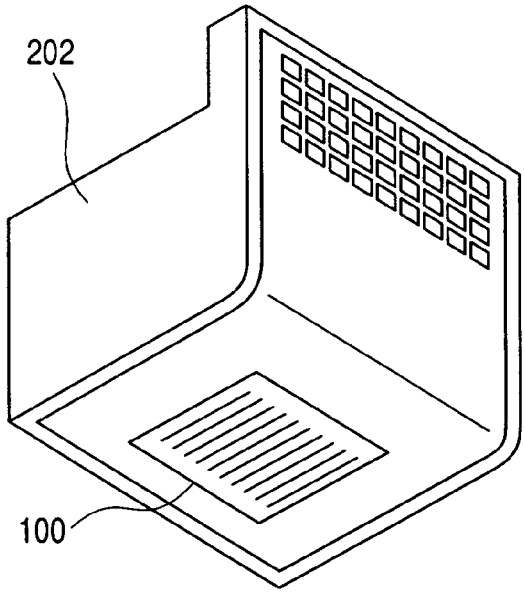
FIG. 8 is a perspective view showing a condition that the ink jet head according to the first embodiment of the present invention is mounted to a head main body.

That is to say, more specifically, as shown in FIG. 8, the ink jet head 100 according to the illustrated embodiment is mounted to a head main body 202 and, as shown in FIG. 7, the head main body 202 is mounted on the carriage 201. Y color, M color and C color ink cartridges 202-Y, 202-M and 202-C are detachably mounted on the carriage 201. Y color, M color and C color inks are supplied from the ink cartridges 202-Y, 202-M and 202-C to the Y, M and C nozzle arrays 102-Y, 102-M and 102-C, respectively.

Further, as shown in FIG. 6, the ink jet printer 200 according to the illustrated embodiment includes a main scan mechanism 204 and a sub-scan mechanism 205. The main scan mechanism 204 supports the carriage 201 for a moving movement in the main scan direction and the sub-scan mechanism 205 moves a print medium P in the sub-scan direction at a position opposed to the ink jet head 100.

Further, the ink jet printer 200 according to the illustrated embodiment includes an integration control circuit (not shown) consisting of a microcomputer, driver circuits and the like. Operations of the ink jet head 100, of the main scan mechanism 204 and of the sub-scan mechanism 205 are integrated and controlled by means of the integration control circuit.

In the above-mentioned arrangement, the ink jet printer 200 according to the illustrated embodiment can form a color image on a surface of the print medium P. In this case, the print medium P is moved in the sub-scan direction by the sub-scan mechanism 205 and the ink jet head 100 is reciprocally moved in the main scan direction by the main scan mechanism 204. In this case, since the ink droplets D are discharged from the ink nozzles 101 of the ink jet head 100 toward the print medium P, the ink droplets D are adhered to the print medium P to form the color image in a matrix pattern.

As shown in FIG. 2, in the ink jet head 100 according to the illustrated embodiment, as mentioned above, regarding the right and left nozzle arrays 102-1 and 102-2 having the same color ink droplet D and the same diameter, periods T of the arrangements of the ink nozzles 101 are the same, but the phases are deviated by a half period t. Thus, by operating all of the nozzle arrays 102 simultaneously, pixels obtained by the ink droplets D can be arranged on the print medium P in the sub-scan direction with the pitch of t.

Further, the ink jet printer 200 according to the illustrated embodiment forms a secondary color falsely by adjusting density of Y color, M color and C color pixels. Incidentally, in a case where higher image quality is realized, it is appropriate that the diameter of the dot is selected to about 20 μm as an aim. The reason is that a lower limit is reached when the dot diameter becomes about 20 μm in the viewpoint of a viewing ability for the pixel. Regarding this, when it is assumed that the dot strikes against a paper having ink blotting rate of about 20%, a lower limit of the discharge amount corresponds to about 0.5 pl.

In the ink jet printer 200 according to the illustrated embodiment, a plurality of operating modes are provided so that the modes can be switched and various recording operations can be carried out in correspondence to the operating modes. For example, in a high image quality mode, when the ink jet head 100 is reciprocally moved in the main scan direction, all of the nozzle arrays 102 are activated in both forward and backward strokes by performing several scanning operations with low duty.

On the other hand, among the plural operating modes, in a high speed mode, since it is desired that the image be formed with the least main scanning operations, when the ink jet head 100 is reciprocally moved in the main scan direction, the recording having high duty must be performed by one main scanning operation. In particular, in a case where the recording is tried to be achieved by a head which discharges a small liquid droplet having a dot diameter of about 20 μm, even in case of mono-color recording, the recording is performed by using the plural nozzle rows (for example, 101-CL1, 101-CS1, 101-CL2, and 101-CS2).

Further, in case of the recording of the secondary color, the number of the nozzle rows used is increased. In this case, the Inventor has ascertained that, depending upon a distance between the used nozzle rows, a way in which the ink mist 20 (see FIGS. 9A and 9B) is adhered to the water-repelling surface 11 is varied.

Figure 9A:
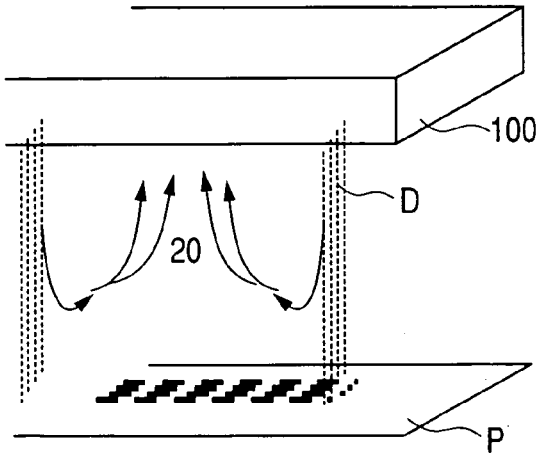
FIG. 9A is a schematic view showing a flow of ink mist caused by ink discharging when a distance between nozzles used is adequately great and FIG. 9B is a schematic view showing a flow of ink mist caused by ink discharging when a distance between nozzles used is small.
Figure 9B:
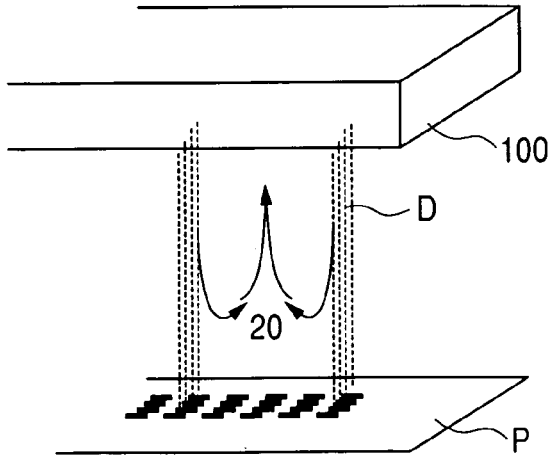

Now, adhesion of the ink mist on the basis of the distance between the used nozzle rows will be explained. Comparison is made regarding states of face mist regions 21 generated after the recording was performed by using the nozzles having the same discharge amount under a condition that frequency, duty and the number of nozzle rows are the same, respectively, and a distance between the head and the print medium is kept to about 1.7 mm. As shown in FIG. 9A, in a case where the distance between the used nozzle rows is adequately wide, since the ink mist is adhered to a relatively wide range, the number of large face wet regions 21 (see FIG. 10) generated is few. On the other hand, as shown in FIG. 9B, in a case where the distance between the used nozzle rows is narrow, since air flows caused by the discharging and the reciprocal movement of the head are interfered with each other to be stronger, ascending air flows are promoted toward the face surface. Further, by the action of air flows caused by the scanning movement of the head and the ink discharging, the ink mist 20 is apt to be concentrated at the center portion of the nozzle row.

Figure 10:
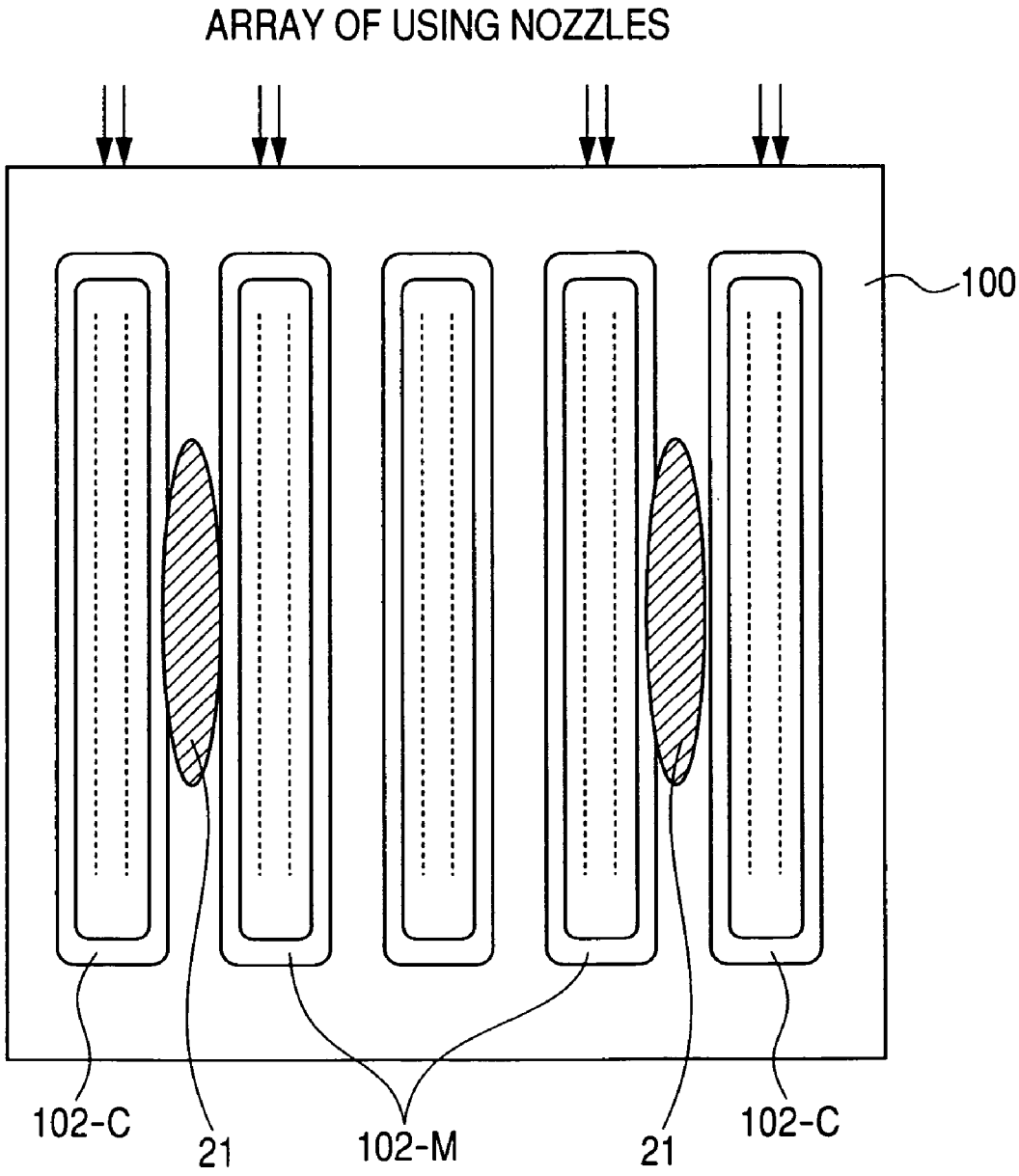
FIG. 10 is a schematic plan view showing an area where face mist is collected after the recording, in an arrangement of an ink jet head according to an embodiment of the present invention.

As a result, as shown in FIG. 10, after the recording is performed by using the cyan ink nozzle rows 102-C and the magenta ink nozzle rows 102-M simultaneously, the ink mist 20 is apt to be concentrated between both color nozzle rows, thereby generating many large face wet regions 21. In particular, when the recording was performed by using driving frequency of 30 kHz and by activating the nozzle rows 102-C and 102-M simultaneously with 100% duty, it was observed that a large amount of face wet regions 21 are gathered in case of the water-repelling surface greater than 500 μm.

Figure 11A:
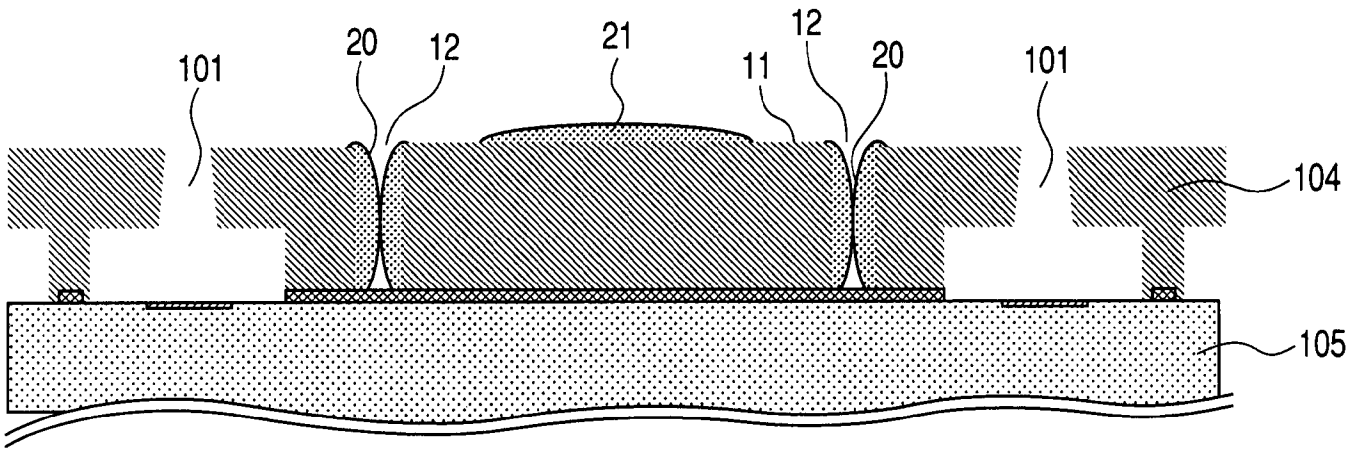
FIG. 11A is a schematic sectional view showing face wet regions on a face surface of the ink jet head according to the embodiment of the present invention after the recording.
Figure 11B:
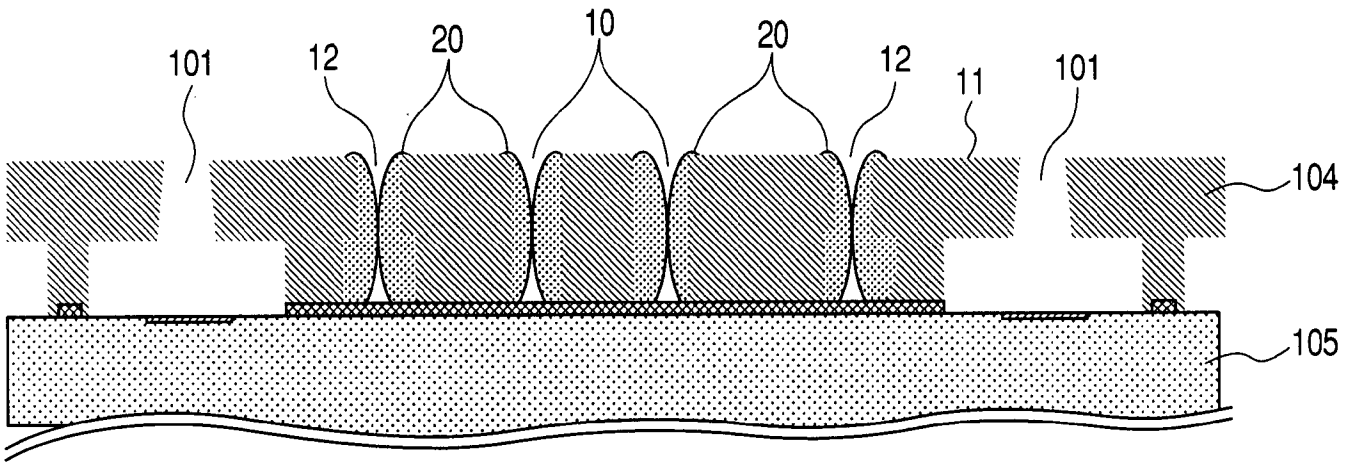
FIG. 11B is a schematic sectional view showing face wet regions on a face surface of an ink jet head having a conventional arrangement after the recording.

The hydrophilic groove 10 which is one of the characteristics of the present invention particularly exhibits the effect when the recording is performed with high frequency and high duty as mentioned above. That is to say, since the capillary force is greater at the end portions of the groove than at the central portion thereof, the trapped ink mist 20 flows along the wall portions of the nozzle plate constituting material from the central portion to the end portions and is accumulated therein. Thus, even in a case where the ink mist 20 is apt to be accumulated on the water-repelling surface 11 as is in the conventional case shown in FIG. 11A, the ink can be moved toward the ends of the recording head via the hydrophilic grooves 10 before the large amount of ink is accumulated on the water-repelling surface, as shown in FIG. 11B.

Accordingly, in the conventional arrangements, although the ink mist 20 is apt to be accumulated to generate many face wet regions 21 thereby to cause dot mis-alignment and non-discharge, in the arrangement of the present invention, occurrence of large amount of face wet regions can be suppressed. Furthermore, since over flow of the ink mist from the hydrophilic grooves 10 is prevented by adopting the arrangement in which the ink mist 20 is not concentrated at the central area of the ink jet head, the effect for preventing the occurrence of the face wet region 21 on the face surface 11 is further enhanced.

As a result, even when the nozzles for the small liquid droplet are driven with high frequency, which causes a problem in achieving high image quality and high speed recording, the non-discharge phenomenon caused by the face wetting due to the ink mist can be suppressed, thereby enhancing the recording continuation performance.

For example, when the recording was performed with high duty by activating the cyan ink nozzle rows 102-C and the magenta ink nozzle rows 102-M simultaneously, it was found that the illustrated embodiment exhibits solid recording continuation performance greater than the conventional arrangements by two times or more.

Incidentally, the present invention is not limited to the illustrated embodiment of the head, but various alterations can be made without departing from the scope of the invention. For example, in the illustrated embodiment, an example that, since only the large amount nozzle arrays 102-YL1 and 102-YL2 are formed for the Y color which has less influence upon the image quality, the structure of the ink jet head 100 is simplified was explained. However, it is possible to construct the ink jet head to have both the large amount nozzle arrays 102-L1 and 102-L2 (for discharging large liquid droplets) for all or some of Y, M and C colors and the small amount nozzle arrays 102-S1 and 102-S2 for achieving the high image quality and high gradation.

Similarly, in the illustrated embodiment, while an example that only the ink jet head 100 for Y, M and C colors is mounted on the ink jet printer 200 was explained, an ink jet head for K (black) color can further be mounted. Further, ink jet head(s) for color(s) other than the Y, M and C colors can be mounted on the ink jet printer (not shown).

Further, in the illustrated embodiment, an example that, when the ink jet printer 200 reciprocally moves the ink jet head 100 in the main scan direction, all of the nozzle arrays 102 are always activated was explained. However, for example, when the ink jet head 100 is moved to the right in FIG. 1, only the right side nozzle arrays 102-1 can be activated, whereas, when the ink jet head is moved to the left, only the left side nozzle arrays 102-2 can be activated.

Further, in the illustrated embodiment, while an example that the heat generating element 107 is used as the ink discharge means for discharging the ink droplet D from the ink nozzle 101 was explained, a vibrating element (not shown) can be used instead of the heat generating element.

In the past, when the plural nozzle rows were activated substantially simultaneously upon the printing, the ink mist was locally adhered to the water-repelling surface (face surface) between the respective nozzle arrays and was gathered or concentrated, with the result that the face wet regions would be generated. However, according to the present invention, before the face wet regions are gathered to form the large face wet region having a dimension of several hundred μm which can easily be moved on the face surface, the face wet regions are dispersed. Thus, it is possible to prevent the gathered large face wet region from moving on the water-repelling surface. That is to say, according to the present invention, as mentioned above, by trapping the face wet regions by the hydrophilic groove formed in the face surface, the non-discharge during the recording which would be caused due to the large face wet region can be improved.

Second Embodiment

Figure 12A:
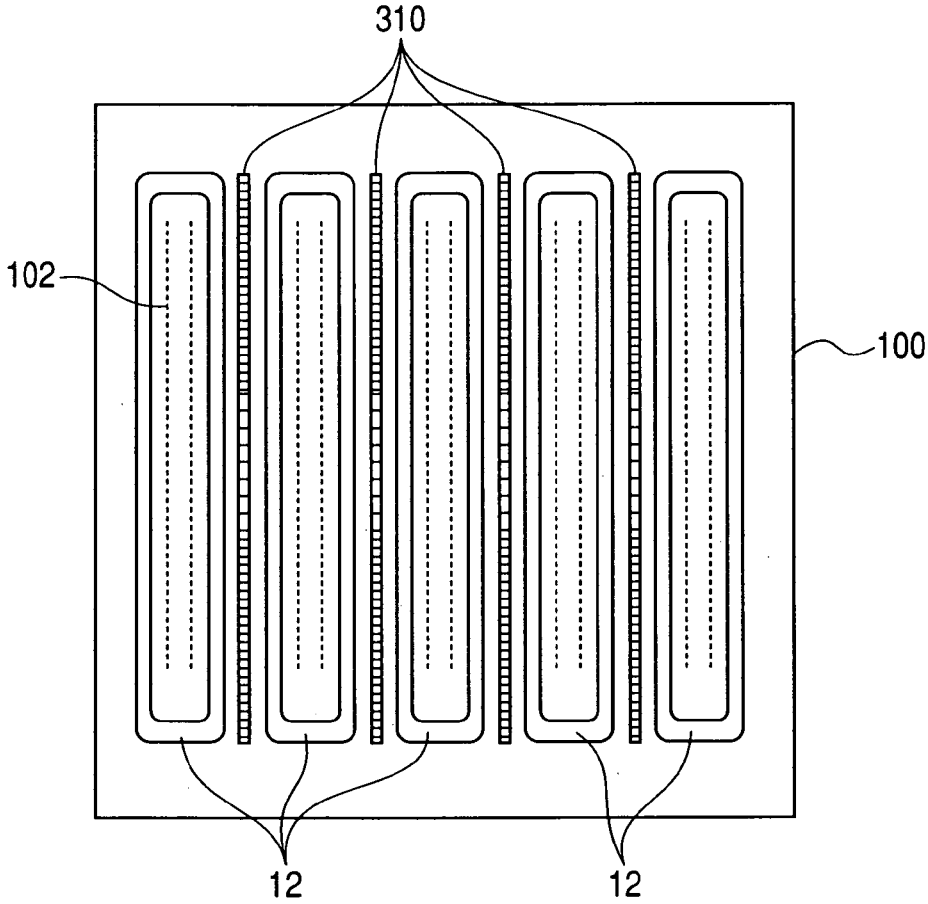
FIG. 12A is a plan view showing patterns of ink nozzles and hydrophilic grooves of an ink jet head according to a second embodiment of the present invention.
Figure 12B:
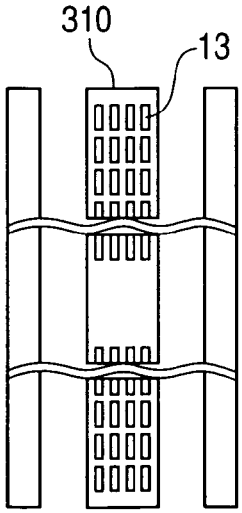
FIG. 12B is a partial enlarged view showing the patterns of the ink nozzles and the hydrophilic grooves of the ink jet head according to the second embodiment of the present invention.

FIG. 12A is a plan view showing patterns of ink nozzles and hydrophilic grooves of an ink jet head according to a second embodiment of the present invention, and FIG. 12B is a partial enlarged view showing such patterns.

The ink jet head according to the second embodiment differs from that of the first embodiment in the point that the whole widths of the central portion and of the end portions of the nozzle row are constant. Further, within a hydrophilic groove 310 of the ink jet head according to the second embodiment, a plurality of projections 13 formed from the nozzle plate constituting member are provided, which also differs from the first embodiment.

Incidentally, a distance (referred to as "gap distance") between the projections 13 and a distance (referred to as "gap distance") between the projection 13 and a recess formed in a wall portion of the nozzle plate within the whole width of the hydrophilic groove 310 respectively are set so that a capillary force becomes greater at end portions thereof than at a central portion thereof. That is to say, at the central portion of the nozzle row, the distances are set to be wide so that the ink mist 20 is dispersed, whereas, at the end portions of the nozzle row, the distances are set to be narrow so that the ink mist 20 is held.

Incidentally, the whole width of the hydrophilic groove 310 along the main scan direction is set to be smaller than 200 μm so that the face wet region 21 is hard to be moved on the water-repelling surface 11. That is to say, a single groove having a width of about 400 μm is provided between the different color nozzle arrays and, regarding the gap distance between the plural projections 13, the gap distance is set to about 20 μm at the end portions of the nozzle array and the gap distance is set to about 100 μm at the central portion of the nozzle array so that the gap distance is gradually changed.

Incidentally, similar to the first embodiment, if the recesses 12 are not provided, since the areas of the water-repelling surfaces between the Y color nozzle array 102-Y and the M color nozzle array 102-M and the C color nozzle array become great, it is preferable that the width of each hydrophilic groove 310 is widened. Alternatively, the number of the hydrophilic grooves 310 may be increased.

Also in this second embodiment, similar to the first embodiment, the solid recording continuation performance greater than the conventional ones by two times or more can be achieved.

Third Embodiment

Figure 13:
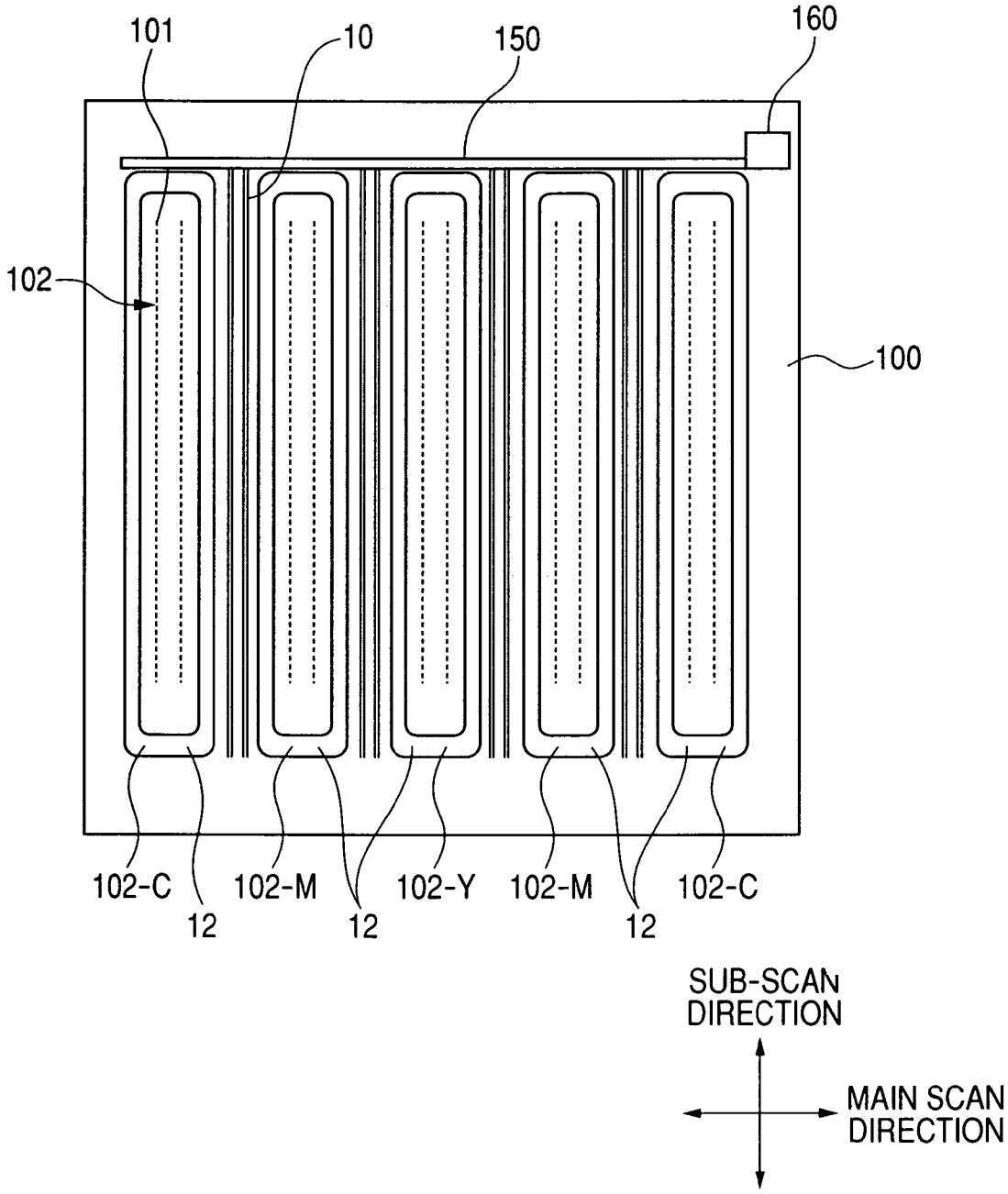
FIG. 13 is a plan view showing patterns of ink nozzles and hydrophilic grooves of an ink jet head according to a third embodiment of the present invention.

FIG. 13 is a plan view showing patterns of ink nozzles and hydrophilic grooves of an ink jet head according to a third embodiment of the present invention. The ink jet head according to the third embodiment differs from that of the first embodiment in the point that a collection groove 150 for communicating ends of the plural hydrophilic grooves 10 with each other and an absorbing member 160 contacted with the collection groove are provided.

In the ink jet head according to the illustrated embodiment, after the ink situated at the central portion of each hydrophilic groove 10 is moved toward the end portions of the groove by a capillary force of the hydrophilic groove 10, the ink is then moved into the collection groove 150. The ink moved to the collection groove 150 is absorbed by the absorbing member 160 made of porous material such as urethane foam. With this arrangement, the ink mist can be trapped by the absorbing member 160 positively and the discharging condition can be kept more stable. Incidentally, the ink collected in the absorbing member 160 may be vaporized during non-recording or may be collected by a pump (not shown) provided in the ink jet printer when the recording head is cleaned.

This application claims priority from Japanese Patent Application No. 2004-265271 filed Sep. 13, 2004, which is hereby incorporated by reference herein.

What is claimed is:

1. An ink jet head in which an ink droplet is discharged from any of plural ink nozzles toward a recording medium when said ink jet head is moved relative to the recording medium, said ink jet head comprising:

an orifice plate having a plurality of rows of nozzle arrays in which the plural ink nozzles are provided in the relative moving direction;

a substrate provided with an ink supply port for supplying ink to the ink nozzles; and a concave groove having a hydrophilic property higher than that of a surface of said orifice plate between the plurality of rows of nozzle arrays on the surface of said orifice plate and formed continuously along the nozzle arrays, wherein a capillary force of said groove is greater at end portions thereof in an arranging direction of the ink nozzles than at a central portion thereof.

2. An ink jet head according to claim 1, wherein the nozzle arrays on both sides of said concave groove discharge different color inks.

3. An ink jet head according to claim 1, wherein a width of said concave groove is greater at the central portion thereof than at the end portions thereof.

4. An ink jet head according to claim 1, wherein said concave groove is formed at a substantially middle portion between the plural nozzle arrays.

5. An ink jet head according to claim 1, wherein a longitudinal length of said concave groove is greater than a length of the nozzle arrays.

6. An ink jet head according to claim 1, wherein a width of said concave groove is less than 500 μm.

7. An ink jet head according to claim 1, wherein a distance between said concave groove and one of the nozzle arrays adjacent to said concave groove is less than 500 μm.

8. An ink jet head according to claim 1, further comprising a plurality of concave grooves and a collection groove for communicating ends of said plurality of concave grooves with each other.

9. An ink jet recording apparatus using an ink jet head according to claim 1, comprising:

a main scan mechanism for moving said ink jet head in a main scan direction;

a sub-scan mechanism for moving the recording medium in a sub-scan direction at a position opposed to said ink jet head;

an integration control circuit for integrating and controlling operations of said ink jet head, said main scan mechanism and said sub-scan mechanism; and cap means for recovering a function of the ink nozzles, wherein said ink jet head is held by said main scan mechanism so that the plural nozzle arrays are aligned along the main scan direction.

10. A method for manufacturing an ink jet head in which an ink droplet is discharged from any of plural ink nozzles toward a recording medium, comprising the steps of:

providing an orifice plate having a plurality of rows of nozzle arrays in which the plural ink nozzles are provided and a substrate provided with an ink supply port for supplying ink to the ink nozzles; and forming a concave groove having a hydrophilic property higher than that of a surface of the orifice plate between the plurality of rows of nozzle arrays on the surface of the orifice plate and formed continuously along the nozzle arrays, wherein a capillary force of the groove is greater at end portions thereof in an arranging direction of the ink nozzles than at a central portion thereof.

* * * * *